United States Patent [19]

Jönsson

[11] 4,093,387

[45] June 6, 1978

[54] FASTENER FOR DETACHABLY INTERCONNECTING PUNCHED DOCUMENTS

[75] Inventor: Otto Julius Jönsson, Malmo, Sweden

[73] Assignee: AB Malmo PAC, Malmo, Sweden

[21] Appl. No.: 553,766

[22] Filed: Feb. 27, 1975

Related U.S. Application Data

[63] Continuation of Ser. No. 385,198, Aug. 2, 1973, abandoned.

[51] Int. Cl.[2] ..... B42F 3/00

[52] U.S. Cl. ..... 402/19; 402/14; 24/153

[58] Field of Search ..... 402/14, 15, 8, 19, 20, 402/70; 24/153 R, 153 PB; 85/49

[56] References Cited

U.S. PATENT DOCUMENTS

| | | | |
|---|---|---|---|
| 1,100,446 | 6/1914 | Ramirez | 24/153 R |
| 2,323,393 | 7/1943 | Hartmann | 402/15 |
| 2,352,407 | 6/1944 | Potts | 402/14 |

FOREIGN PATENT DOCUMENTS

| | | | |
|---|---|---|---|
| 248,560 | 8/1962 | Australia | 402/15 |
| 229,851 | 9/1944 | Switzerland | 402/14 |
| 14,436 of | 1903 | United Kingdom | 402/19 |
| 686,388 | 1/1953 | United Kingdom | 402/14 |
| 20,126 of | 1907 | United Kingdom | 402/14 |

*Primary Examiner*—Jerome Schnall
*Attorney, Agent, or Firm*—Ladas, Parry, Von Gehr, Goldsmith & Deschamps

[57] ABSTRACT

A fastener for detachably interconnecting punched documents is formed as a flat strip of plastics material, which has at its ends oppositely angled projecting tongues to be inserted into the holes in the documents.

1 Claim, 3 Drawing Figures

FASTENER FOR DETACHABLY INTERCONNECTING PUNCHED DOCUMENTS

This is a continuation of application Ser. No. 385,198 filed Aug. 2, 1973, now abandoned.

The present invention relates to a fastener for detachably interconnecting punched documents, comprising a flat strip which is shaped at its ends so as to form tongues projecting from the ends as extensions of the strip and intended to be inserted each through one hole in the sheaf of documents with an intermediate portion of the strip engaging the sheaf of documents between the holes on one side of the sheaf and the tongues located on the other side of the sheaf.

Prior-art fasteners of this kind are made of metal, in which case the tongues after being inserted through the holes from one side of the sheaf of papers are bent towards or away from each other at the other side of the sheaf. As a result, the documents in the sheaf are held securely together so that it is possible to leaf through the documents without their falling apart. However, when the documents have to be taken out from the sheaf, which will happen not unfrequently, for instance with respect to case sheets for hospital patients, such case sheets being interconnected to sheaves with one or more sheaves lying loose in a file or the like, the repeated bending of the tongues results in the tongues breaking and making it necessary to replace the fastener. The manipulation of this prior-art fastener is not complicated but is still a finicy work which it is desirable to avoid.

The object of the invention is to provide a fastener of the kind referred to above which will hold the documents in the sheaf securely together and which is very simple to handle when the documents are to be interconnected or detached from each other and furthermore - not least important - which is capable of standing almost any number of mounting and dismounting operations without breaking.

This object is achieved according to the invention by a fastener of the kind referred to which is characterized in that the tongues which are essentially plane parallel with the intermediate portion are oppositely angled in relation to the longitudinal direction of the fastener.

Figure 1:
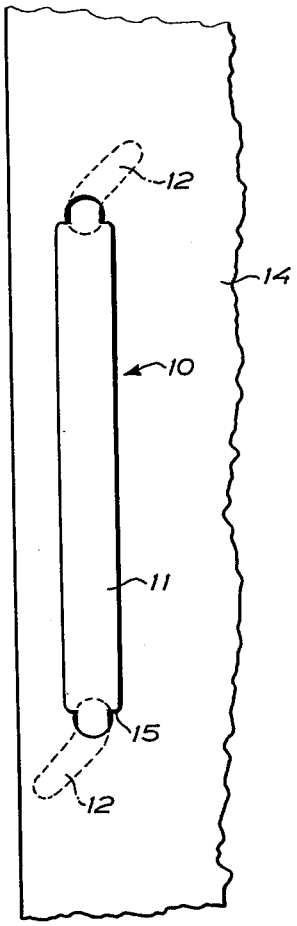
Figure 2:
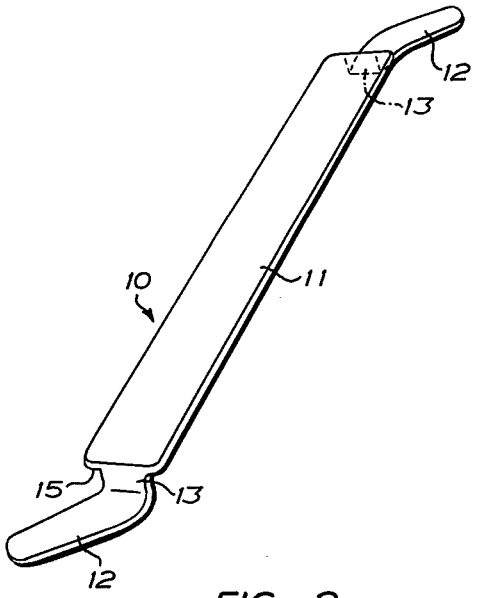
Figure 3:
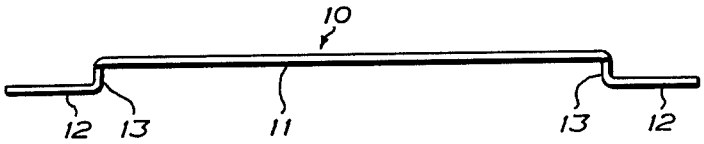

Embodiments of the invention will be described with reference to the accompanying drawing, in which FIG. 1 is a plan view of a partly shown sheaf of documents with a fastener in one embodiment, FIG. 2 is a perspective view of a second embodiment, and FIG. 3 is a side view of said second embodiment.

Both fasteners shown in the drawing comprise a resiliently flexible strip 10 of plastic material, e.g. PVC, which has a flat central portion 11 and, at each end of the said central portion, a tongue 12 which is plane parallel to the central portion and disposed at an angle in relation to the longitudinal direction of the fastener in one and the other direction, respectively, said angle being approximately 45°. The tongue tapers slightly towards its tip which is smoothly rounded. The difference between the two embodiments consists in the tongues according to FIG. 1 being in the same plane as the central portion, while the tongues according to FIG. 2 are displaced in relation to the central portion in the transverse direction of the plane thereof and are united with the said portion by means of webs 13 disposed at right angles to the said plane.

When the fastener is to be used for joining a sheaf of documents which have been punched in a conventional manner and which is partly outlined at 14 in FIG. 1, one tongue 12 is first introduced into a hole, whereupon the second tongue is introduced into another hole, its central portion 11 being bent or curved resiliently at the same time. Of course, the length of the fastener must be matched to the distance between the holes (standard distance) so that the central portion after the fastener has resiliently straightened itself out will lie essentially plane against the sheaf of documents on one side thereof, while the tongues are on the other side of the sheaf and will lie essentially plane against it. The embodiment according to FIG. 1 is used for thin sheaves while the embodiment according to FIG. 2 is used for thick sheaves. The webs 13 may have different heights for use of the fastener within different thickness ranges. The central portion 11 has a width which is slightly greater than the diameter of the holes, to form at the transition between each tongue and the central portion abutments 15, whereby the fastener is kept in position between the holes without having any possibility of sliding more deeply into one hole, while the tongue at the other end will slide out of the associated hole.

The angled tongues may be straight or slightly curved. In order to avoid that the central portion 11 of the fastener will bow from the sheaf of documents as will happen if the embodiment according to FIG. 1 is used in order to hold together a too thick sheaf of documents, the embodiment according to FIG. 2 having a web 13 is preferred as the most usable embodiment.

I claim:

1. An improved one-piece fastener in the form of a thin flat strip of resilient material for detachably interconnecting punched documents assembled in a sheaf, comprising an elongated planar intermediate portion adapted to engage, at one of the flat surfaces thereof, the sheaf of documents between the holes therein on one side of the sheaf, a planar end portion at each of the opposite ends of the intermediate portion having reduced width with respect to said intermediate portion, said end portions being disposed in a common plane essentially parallel to the plane of the intermediate portion but displaced transversely thereof and extending away from each other, and a web integrally interconnecting said intermediate portion and each of said end portions and forming a step therebetween, said end portions being insertable each through one hole in the sheaf from the said one side thereof in order to extend along the opposite side of the sheaf, with said webs extending through the holes, wherein the improvement resides in that the end portions are angled in said essentially parallel plane in opposite directions in relation to said intermediate portion to form laterally projecting tongues.

* * * * *